US006386140B1

(12) United States Patent
Müller et al.

(10) Patent No.: US 6,386,140 B1
(45) Date of Patent: May 14, 2002

(54) PLASMA SPRAYING APPARATUS

(75) Inventors: Markus Müller, Dintikon; Christian Märki, Staufen, both of (CH)

(73) Assignee: Sulzer Metco AG, Wohlen (CH)

( * ) Notice: Subject to any disclaimer, the term of this patent is extended or adjusted under 35 U.S.C. 154(b) by 0 days.

(21) Appl. No.: 09/579,252

(22) Filed: May 25, 2000

(30) Foreign Application Priority Data

Jun. 30, 1999 (CH) ..... 1211/99

(51) Int. Cl.[7] ..... H05H 1/00
(52) U.S. Cl. ..... 118/723 E
(58) Field of Search ..... 156/345; 118/723 E, 118/723 ER

(56) References Cited

U.S. PATENT DOCUMENTS

| | | | |
|---|---|---|---|
| 4,661,682 | A | 4/1987 | Gruner et al. |
| 5,328,516 | A | 7/1994 | Dietiker |
| 5,519,183 | A | 5/1996 | Mueller |

FOREIGN PATENT DOCUMENTS

| | | |
|---|---|---|
| DE | 3100824 | 7/1982 |
| EP | 0171793 | 2/1986 |
| EP | 0585203 | 3/1994 |
| EP | 0645946 | 3/1995 |

*Primary Examiner*—Thi Dang
(74) *Attorney, Agent, or Firm*—Tarolli, Sundheim, Covell, Tummino & Szabo L.L.P.

(57) ABSTRACT

A plasma spraying apparatus is provided comprising a plasma gun shaft member and a plasma gun head member, connected to the plasma gun shaft member and adapted to create a plasma torch escaping radially from the head member. In order to enable the plasma gun head member and, thereby, those parts and elements thereof that are subject to wear quickly and easily, the plasma gun head member is of modular design. For fixing the plasma gun head member to the plasma gun shaft member, the electrical contact elements provided for transmitting electrical power on the plasma gun head member are used. These electrical contact elements tower above that front face of the plasma gun head member that is intended to be connected to the plasma gun shaft member. Clamping the head member to the shaft member is accomplished by means of quick release lever members provided on the shaft member. That lever members are provided with eccentric portions engaging recesses provided on the electrical contact elements.

14 Claims, 2 Drawing Sheets

PLASMA SPRAYING APPARATUS

BACKGROUND OF THE INVENTION

The present invention refers to a plasma spraying apparatus, particularly for coating the interior walls of tubes and pipes. The plasma spraying apparatus generally comprises a plasma gun shaft member and a plasma gun head member adapted to be fixed to said plasma gun shaft member and having means for creating a plasma torch escaping in radial direction.

PRIOR ART

Plasma spraying apparatuses having means for creating a plasma torch escaping in radial direction are particularly suited for coating the interior walls of tubes and pipes. In order to enable a relatively small tube or pipe, having an interior diameter of for example 40 mm, to be coated, the plasma spraying apparatus and, particularly, the plasma gun head member, have to be of very compact design. However, if the size of a plasma gun head member is reduced, several problems arise. For example, the thermal load of the plasma gun head member is increased. The result is that certain parts and elements of the plasma gun head, particularly, the cathode thereof as well as the anode, usually designed as a nozzle, are subject to considerable wear. The useful life of these parts and elements is negatively influenced also by the bad heat dissipation during the operation of coating the interior walls of small tubes and pipes.

OBJECTS OF THE INVENTION

Thus, it is an object of the present invention to provide a a plasma spraying apparatus, particularly for coating the interior walls of tubes and pipes, having a plasma gun head member that can quickly and easily be replaced. A further object of the invention is to provide a plasma spraying apparatus, particularly for coating the interior walls of tubes and pipes, in which the parts and elements of the apparatus that are subject to wear can easily and quickly be replaced.

SUMMARY OF THE INVENTION

To meet these and other objects, the invention provides, in a first aspect, a plasma spraying apparatus, particularly for coating the interior walls of tubes and pipes, comprising a plasma gun shaft member having a central longitudinal axis, and a plasma gun head member having a central longitudinal axis, adapted to be fixed to the plasma gun shaft member and having means for creating a plasma torch escaping in radial direction.

The plasma gun head member comprises an anode base body member, a cathode base body member and an insulating body member located between the anode base body member and the cathode base body member. The anode base body member is provided with at least one electrical contact element adapted to transmit operating power from the plasma gun shaft member to the plasma gun head member, and the cathode base body member is also provided with at least one electrical contact element adapted to transmit operating power from the plasma gun shaft member to the plasma gun head member.

The plasma gun shaft member is provided with quick release clamping means for connecting the plasma gun head member to the plasma gun shaft member, whereby the insulating body member towers above the face of the plasma gun head member that is intended to be connected to the plasma gun shaft member. Moreover, the insulating body member is provided with surface means adapted to be engaged by the quick release clamping means provided on the plasma gun shaft member.

According to a second aspect, the invention provides a plasma spraying apparatus, particularly for coating the interior walls of tubes and pipes, comprising a plasma gun shaft member having a central longitudinal axis, and a plasma gun head member having a central longitudinal axis, adapted to be fixed to the plasma gun shaft member and having means for creating a plasma torch escaping in radial direction.

The plasma gun head member comprises an anode base body member, a cathode base body member and an insulating body member located between the anode base body member and the cathode base body member. The anode base body member is provided with at least one electrical contact element adapted to transmit operating power from the plasma gun shaft member to the plasma gun head member, and the cathode base body member is also provided with at least one electrical contact element adapted to transmit operating power from the plasma gun shaft member to the plasma gun head member.

The plasma gun shaft member is provided with quick release clamping means for connecting the plasma gun head member to the plasma gun shaft member, whereby the electrical contact element provided on the anode base body member and the electrical contact element provided on the cathode base body member tower above the face of the plasma gun head member that is intended to be connected to the plasma gun shaft member and is provided with surface means adapted to be engaged by said quick release clamping means provided on the plasma gun shaft member.

According to a third aspect, the invention provides a plasma spraying apparatus, particularly for coating the interior walls of tubes and pipes, comprising a plasma gun shaft member having a central longitudinal axis, and a plasma gun head member having a central longitudinal axis, adapted to be fixed to the plasma gun shaft member and having means for creating a plasma torch escaping in radial direction.

The plasma gun head member comprises an anode base body member, a cathode base body member and an insulating body member located between the anode base body member and the cathode base body member. The anode base body member is provided with at least one electrical contact element adapted to transmit operating power from the plasma gun shaft member to the plasma gun head member, and the cathode base body member is also provided with at least one electrical contact element adapted to transmit operating power from the plasma gun shaft member to the plasma gun head member.

The plasma gun shaft member is provided with quick release clamping means for connecting the plasma gun head member to the plasma gun shaft member, whereby the insulating body member as well as the electrical contact element provided on anode base body member and the electrical contact element provided on the cathode base body member tower above the face of the plasma gun head member that is intended to be connected to the plasma gun shaft member and is provided with surface means adapted to be engaged by the quick release clamping means provided on the plasma gun shaft member.

BRIEF DESCRIPTION OF THE DRAWINGS

In the following, an embodiment of the apparatus according to the invention will be further described, with reference to the accompanying drawings, in which.

DETAILED DESCRIPTION OF A PREFERRED EMBODIMENT

Figure 2A:
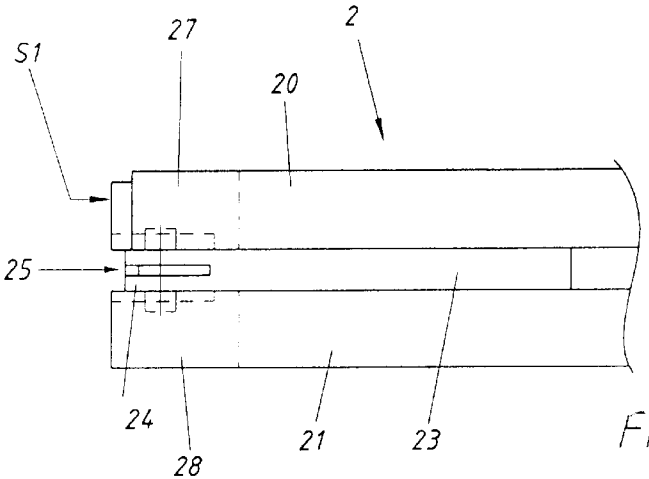
FIG. 2*a* shows a schematic lateral view of the plasma gun shaft member.
Figure 2B:
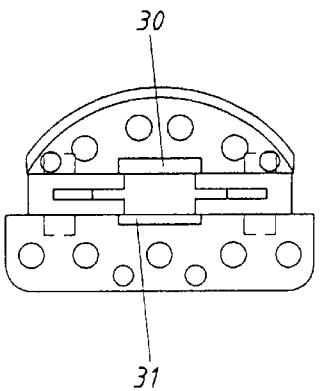
FIG. 2*b* shows a schematic front view of the plasma gun shaft member, depicting the face directed towards the plasma gun head member.
Figure 1A:
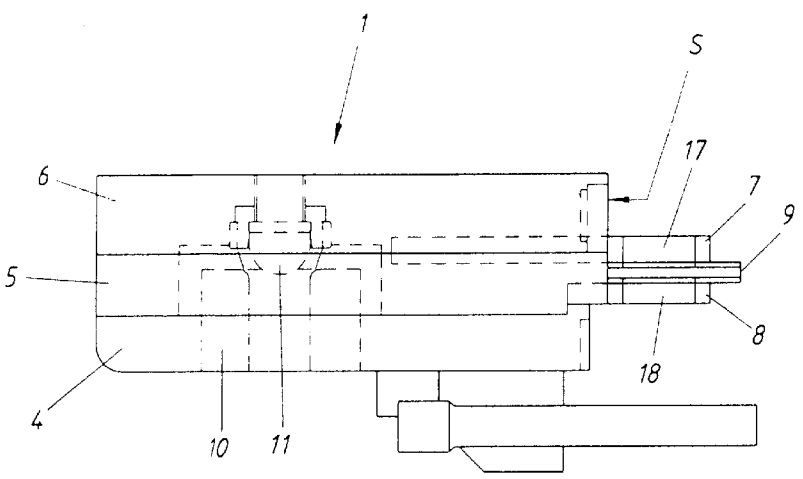
FIG. 1*a* shows a schematic lateral view of a plasma gun head member.
Figure 1B:
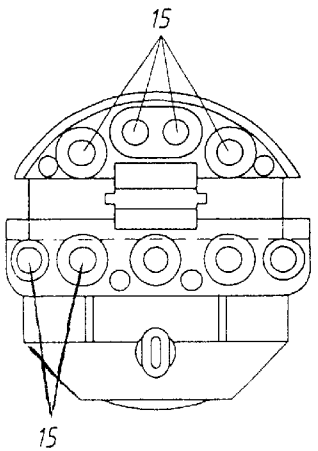
FIG. 1*b* shows a schematic front view of the plasma gun head member, depicting the face directed towards the plasma gun shaft member.

FIGS. 1*a* and 1*b* show the plasma gun head member 1 in two different views, i.e. in a schematic lateral view and in a schematic front view, depicting the face directed towards the plasma gun shaft member. Similarly, FIGS. 2*a* and 2*b* show the plasma gun shaft member 2 in two different views, i.e. in a schematic lateral view and in a schematic front view, depicting the face directed towards the plasma gun head member. It is understood that this drawings are not to scale. Since the general design and the mode of operation of such plasma spraying devices are well known to any person skilled in the art, in the following, only the characteristics of the plasma gun head member and the plasma gun shaft member will be further described that are essential for the present invention.

The plasma gun head member 1 comprises an anode base member 4, a cathode base member 6 and an insulating member 5 inserted between the anode base member 4 and the cathode base member 6. Thus, the anode base member 4 is electrically insulated from the cathode base member 6. The anode base member 4 is provided with an anode nozzle member 10, and the cathode base member 6 is provided with a cathode member 11. Both the anode nozzle member 4 and the cathode member 6 are inserted into the plasma gun head member 1 in a direction running perpendicular to its central longitudinal axis. Thus, a plasma torch created during the operation of the plasma gun head member 1 escapes radially from the plasma gun head member 1.

Both the anode base member 4 and the cathode base member 6 are made of a material that has good electrical conductivity, for example of brass. Thereby, the anode nozzle member 10 is electrically connected to the anode base member 4, and the cathode member 11 is electrically connected to the cathode base member 6. The coating powder is fed to the plasma gun head member 1 by means of tube member 13 located at the exterior of the plasma gun head member 1.

Since the plasma gun head member 1 is of a very compact design, the plasma spraying apparatus is especially suited for coating the interior walls of tubes or pipes, having a diameter of 40 mm and up.

For feeding the media required for the operation and the cooling of the plasma gun head assembly 1, a plurality of channels 15 is provided; however, since every person skilled in the art is familiar with the purpose of these channels, it is not necessary to give further explanations here. For sealing all these channels 15, O-rings (not shown) are provided. A hose (also not shown) required for feeding the coating powder to the plasma gun head member 1 can be connected to the tube member 13 and removed there from, as convenient.

For feeding electric power to the plasma gun head assembly 1, both the anode base member 4 and the cathode base member 6 are provided each with an electric contact element 7 and 8, respectively. The insulating body member 5 comprises a protrusion 9 running between the two afore mentioned contact elements 7, 8. That protrusion electrically insulates the two contact elements 7, 8 from each other. Not only the two contact elements 7, 8, but also the protrusion 9 tower above the face of the plasma gun head member 1 directed towards the plasma gun shaft member 2. Both contact elements 7, 8 are provided with lateral recesses 17, 18; the purpose thereof will be further explained herein after. The protrusion 9 of the insulating member 5 towers above the two contact elements 7, 8 both in lateral and in frontal direction.

The plasma gun shaft member 2 comprises two tube members 20 and 21, respectively, that run parallel to each other with a certain distance between each other. Through their interiors, the media required for the operation of the plasma gun head member 1 are run. Two quick release clamping lever members 23 are located between the two tube members 20, 21. Each of the two clamping lever members 23 are provided, at their front side, with an eccentric portion 24 comprising a slot 25. The front side S1 of the tube members 20, 21 directed towards the plasma gun head member 1 are provided each with a junction member 27 and 28, respectively. Both junction members 27, 28 each comprise a recess 30 and 32, respectively, adapted to receive the contact elements 7, 8 of the plasma gun head member 1.

With the help of FIGS. 3*a* to 3*c*, in the following, it will be explained how the plasma gun head member 1 is attached to the plasma gun shaft member 2. Particularly, FIG. 3*a* clearly shows the design of the quick release clamping lever members 23 as well as the design of the contact elements 7, 8. Moreover, FIG. 3*a* clearly shows that the quick release clamping lever members 23 each are provided with an eccentric portion 24 comprising a slot 25, that the contact elements 7, 8 each are provided with recesses 17, and that the protrusion 9 of the insulating member 5 towers above the two contact elements 7, 8 both in vertical direction as well as in frontal direction, whereby it is understood that FIG. 3*a* shows but the upper contact element 7.

Figure 3C:
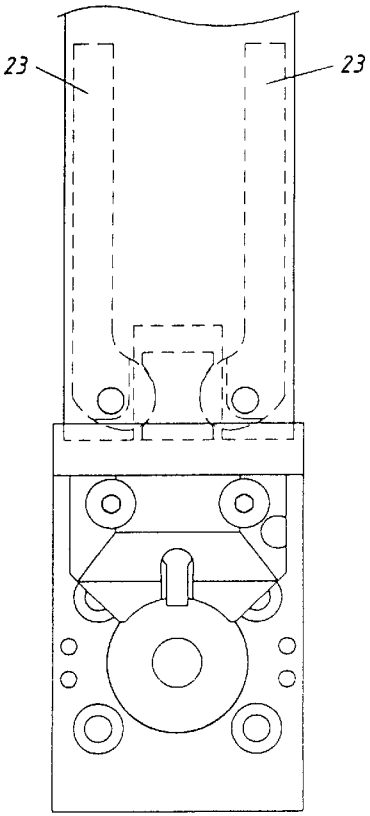
FIGS. 3*a* to 3*c* show schematic top views of the plasma gun head member and the front portion of the plasma gun shaft member in three different phases of connecting the plasma gun head member to the plasma gun shaft member.
Figure 3B:
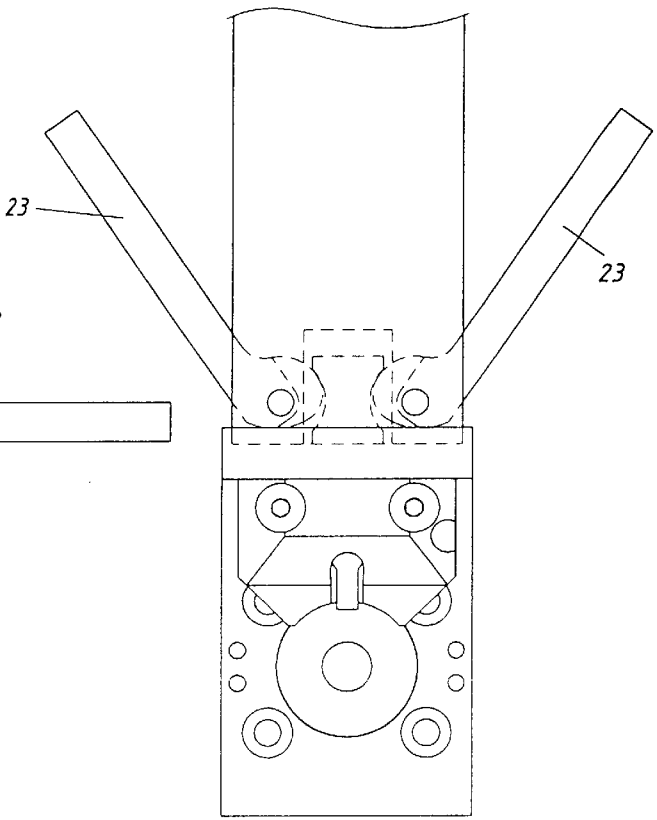
Figure 3A:
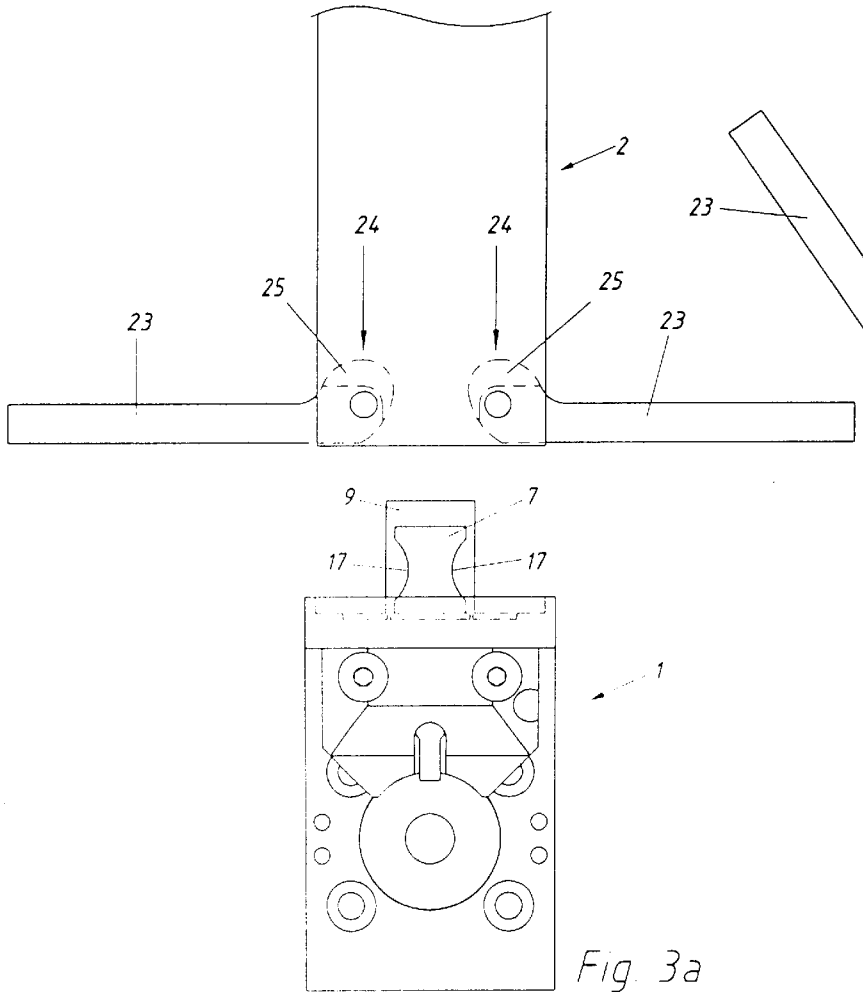

FIG. 3*a* shows a schematic top view of the plasma gun head member 1 as well as of the plasma gun shaft member 2, the plasma gun shaft member 2 having its quick release clamping lever members 23 in the initial position, i.e. in a position in which the plasma gun head member 1 is ready to be fixed to the plasma gun shaft member 2. Thereby, for fixing the plasma gun head member 1 to the shaft member 2, the contact elements 7 of the plasma gun head member 1 are plugged into the corresponding recesses 30 of the plasma gun shaft member 2, and the quick release clamping lever members 23 are rotated (as seen in FIG. 3*b*) in upwards direction. Thus, the eccentric portions 24 of the quick release clamping lever members 23 engage the recesses 17 of the contact elements 7. It is understood that the eccentric portions 24 are designed such that the eccentric portion 24 pulls the contact element 7 towards the plasma gun shaft assembly 2 once the quick release clamping lever members 23 are rotated.

FIG. 3*c* shows a situation where the two quick release clamping lever members 23 are fully rotated into their operating position in which the plasma gun head member 1 is fixed to the plasma gun shaft member 2. Moreover, it is ensured that an electric connection is established between the plasma gun head member 1 and the plasma gun shaft member 2. Last but not least, it is also ensured that the channels 15 of the plasma gun shaft member 2 are operationally connected to corresponding channels provided in the plasma gun head member 1. By the provision of the afore mentioned O-ring sealing members, it is ensured that these channels are reliable sealed. Moreover, the design of the quick release clamping lever members 23 and the provision of the elastically resilient O-ring sealing members ensure that the plasma gun head member 1 is fixed to the plasma gun shaft assembly with a certain bias force; thus, the quick release clamping lever members 23 reliably rest in their locking positions.

Due to the modular design of the plasma gun head member 1 and the design of the contact elements 7, 8, as has been described herein before, and to the design of the quick release clamping lever members 23, it is possible to easily and quickly exchange either the complete plasma gun head member 1 or the remove it and to exchange the parts and elements that are subject to wear, like the anode nozzle member 10 and the cathode 11. Moreover, due to the fact that the contact elements 7, 8 are also used as pull members, besides their real task of transmitting the operating power, the plasma gun head member 1 can be designed as a very small element or assembly. Thanks to the specific design of the protrusion 9 of the insulating body member 5, located between the two contact elements 7 and 8 and towering above that contact elements 7, 8 in lateral and in longitudinal direction, a considerably long insulating path is created between the two contact elements 7 and 8, with the result that the two contact elements 7, 8 are reliably insulated against each other.

It remains to mention that the foregoing described embodiment is only one of many possible modes of realizing the present invention; it is understood that many other possibilities exist within the scope of the appended claims. For example, the contact elements 7, 8 could be provided with protrusions instead of recesses to enable the quick release clamping lever members 23 provided on the plasma gun shaft member 2 to engage the plasma gun head element 1. Moreover, the insulating body member 5 and its protrusion 9, respectively, could be provided with recesses and/or protrusions adapted to engage the quick release clamping lever members 23.

What is claimed is:

1. A plasma spraying apparatus comprising:

a plasma gun shaft means having a central longitudinal axis;

a plasma gun head means having a central longitudinal axis, and adapted to be fixed to said plasma gun shaft means and having means for creating a plasma torch escaping in radial direction;

said plasma gun head means comprising an anode base body member means, a cathode base body member means and an insulating body member means located between said anode base body member means and said cathode base body member means;

said anode base body member means being provided with at least one electrical contact element means adapted to transmit operating power from said plasma gun shaft means to said plasma gun head means, and said cathode base body member means being provided with at least one electrical contact element means adapted to transmit operating power from said plasma gun shaft means to said plasma gun head means;

said plasma gun shaft means being provided with quick release clamping means for connecting said plasma gun head means to said plasma gun shaft means;

said insulating body member means towering above the face of said plasma gun head means that is intended to be connected to said plasma gun shaft means and provided with surface means adapted to be engaged by said quick release clamping means provided on said plasma gun shaft means.

2. A plasma spraying apparatus comprising:

a plasma gun shaft means having a central longitudinal axis;

a plasma gun head means having a central longitudinal axis, and adapted to be fixed to said plasma gun shaft means and having means for creating a plasma torch escaping in radial direction;

said plasma gun head means comprising an anode base body member means, a cathode base body member means and an insulating body member means located between said anode base body member means and said cathode base body member means;

said anode base body member means being provided with at least one electrical contact element means adapted to transmit operating power from said plasma gun shaft means to said plasma gun head means, and said cathode base body member means being provided with at least one electrical contact element means adapted to transmit operating power from said plasma gun shaft means to said plasma gun head means;

said plasma gun shaft means being provided with quick release clamping means for connecting said plasma gun head means to said plasma gun shaft means;

said at least one electrical contact element means provided on said anode base body member and said at least one electrical contact element means provided on said cathode base body member towering above the face of said plasma gun head means that is intended to be connected to said plasma gun shaft means and provided with surface means adapted to be engaged by said quick release clamping means provided on said plasma gun shaft means.

3. A plasma spraying apparatus comprising:

a plasma gun shaft means having a central longitudinal axis;

a plasma gun head means having a central longitudinal axis, and adapted to be fixed to said plasma gun shaft means and having means for creating a plasma torch escaping in radial direction;

said plasma gun head means comprising an anode base body member means, a cathode base body member means and an insulating body member means located between said anode base body member means and said cathode base body member means;

said anode base body member means being provided with at least one electrical contact element means adapted to transmit operating power from said plasma gun shaft means to said plasma gun head means, and said cathode base body member means being provided with at least one electrical contact element means adapted to transmit operating power from said plasma gun shaft means to said plasma gun head means;

said plasma gun shaft means being provided with quick release clamping means for connecting said plasma gun head means to said plasma gun shaft means;

said insulating body member means as well as said at least one electrical contact element means provided on said anode base body member and said at least one electrical contact element means provided on said cathode base body member towering above the face of said plasma gun head means that is intended to be connected to said plasma gun shaft means and provided with surface means adapted to be engaged by said quick release clamping means provided on said plasma gun shaft means.

4. A plasma spraying apparatus according to claim 1, in which said surface means are constituted by recesses.

5. A plasma spraying apparatus according to claim 1, in which said surface means are constituted by protrusions.

6. A plasma spraying apparatus according to claim 1, in which said surface means are constituted by recesses and protrusions.

7. A plasma spraying apparatus according to claim 1, in which two electrical contact elements means are provided, running parallel to said central longitudinal axis of said plasma gun head means, said two electrical contact elements means towering above the face of said plasma gun head means that is intended to be connected to said plasma gun shaft means.

8. A plasma spraying apparatus according to claim 1, in which said insulating body member means comprises a protrusion means extending between said two electrical contact element means, said protrusion means towering above said electrical contact element means both in a lateral direction and in a direction towards said plasma gun shaft means.

9. A plasma spraying apparatus according to claim 1 in which said plasma gun shaft means is provided with two pivotally mounted quick release lever means, each of said two lever means being provided with eccentric means adapted to engage said surface means.

10. A plasma spraying apparatus according to claim 9 in which said eccentric means is provided with a slot means adapted to engage said protrusion means of said insulting body member means upon the fixing of said plasma gun head means to said plasma gun shaft means.

11. A plasma spraying apparatus according to claim 9 in which the shape of said eccentric means as well as the shape of said surface means are matched to each other such as to be adapted to pull said contact elements means towards said plasma gun shaft means upon fixing said plasma head means to said plasma gun shaft means.

12. A plasma spraying apparatus according to claim 1 in which said plasma gun head means comprises two contact element means each provided with a recess means, said plasma gun shaft means being provided with two of said quick release lever means that are operable from an initial rest position to an operating position, whereby said plasma gun shaft means is adapted to receive said quick release lever means once they are in their operating position.

13. A plasma spraying apparatus according to claim 1 in which said electrical contact elements have essentially plate like shape and are arranged parallel to said central longitudinal axis of said plasma gun head member.

14. A plasma spraying apparatus according to claim 1 in which said quick release lever member are made of an electrically insulating material.

* * * * *